US008235011B2

(12) United States Patent
Lengfeld et al.

(10) Patent No.: US 8,235,011 B2
(45) Date of Patent: Aug. 7, 2012

(54) ACTUATING DEVICE

(75) Inventors: Markus Lengfeld, Winnenden (DE); Jens Meintschel, Bernsdorf (DE); Thomas Stolk, Kirchheim (DE); Martin Ströer, Immenstaad (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 230 days.

(21) Appl. No.: 12/658,586

(22) Filed: Feb. 5, 2010

(65) Prior Publication Data

US 2010/0180850 A1 Jul. 22, 2010

Related U.S. Application Data

(63) Continuation-in-part of application No. PCT/EP2008/006016, filed on Jul. 23, 2008.

(30) Foreign Application Priority Data

Aug. 8, 2007 (DE) ..... 10 2007 037 333

(51) Int. Cl.
*F01L 9/04* (2006.01)

(52) U.S. Cl. ..... 123/90.11; 251/129.01; 251/129.16

(58) Field of Classification Search ..... 123/90.11; 251/129.01, 129.16

See application file for complete search history.

(56) References Cited

U.S. PATENT DOCUMENTS

| | | | |
|---|---|---|---|
| 2,980,090 | A | 2/1957 | Sutton et al. |
| 5,070,489 | A | 12/1991 | Perry et al. |
| 5,109,812 | A | 5/1992 | Erickson et al. |
| 5,199,392 | A | 4/1993 | Kreuter et al. |
| 5,450,871 | A | 9/1995 | Reinicke |
| 6,176,208 | B1 | 1/2001 | Tsuzuki et al. |
| 6,199,523 | B1 | 3/2001 | Neubauer et al. |

FOREIGN PATENT DOCUMENTS

| | | |
|---|---|---|
| CN | 1912356 | 2/2007 |
| DE | 198 16 878 | 10/1999 |
| DE | 198 51 507 | 5/2000 |
| DE | 102 11 395 | 10/2003 |
| EP | 0 356 713 | 3/1990 |
| EP | 1 041 252 | 10/2000 |
| EP | 1 050 895 | 11/2000 |
| EP | 1 564 465 | 8/2005 |
| EP | 1 564 466 | 8/2005 |
| FR | 2 808 375 | 11/2001 |
| GB | 573 405 | 11/1945 |
| GB | 612 608 | 11/1948 |
| GB | 616 494 | 1/1949 |
| GB | 637 785 | 5/1950 |
| GB | 692 659 | 6/1953 |
| GB | 726 878 | 3/1955 |
| GB | 913 536 | 5/1961 |
| GB | 913 536 | 12/1962 |
| JP | 935607 | 12/1978 |
| JP | 04 174931 | 6/1992 |
| JP | 09 035 607 | 2/1997 |
| JP | 09 035607 | 2/1997 |
| JP | 2000 199411 | 7/2000 |
| JP | 2001 020767 | 1/2001 |

*Primary Examiner* — Ching Chang
(74) *Attorney, Agent, or Firm* — Klaus J. Bach

(57) ABSTRACT

In an actuating device with at least one electrical or electromagnetic actuation unit, at least two activation sequences performed by different actuation elements of the actuation unit are associated with at least two different electrical and/or electromagnetic states of the actuation unit via electric coil units energized by current flowing in different flow directions.

7 Claims, 3 Drawing Sheets

ACTUATING DEVICE

This is a Continuous-In-Part Application of pending international patent application PCT/EP2008/006016 filed Jul. 23, 2008 and claiming the priority of German patent application 10 2007 037 333.5 filed Aug. 8, 2007.

BACKGROUND OF THE INVENTION

The invention relates to an actuating device for a valve drive change-over unit of an internal combustion engine with an electrical or electromechanical actuation unit.

DE 102 11 395 A1 discloses an actuating device where an activation sequence of an actuation element is performed due to energization of an operating coil.

It is the object of the present invention to provide an actuating device capable of performing activation sequences of several actuation elements which require relatively little installation space and use low-cost components and also provide for a reliable operating mode.

SUMMARY OF THE INVENTION

In an actuating device with at least one electrical or electromagnetic actuation unit, at least two activation sequences performed by different actuation elements of the actuation unit are associated with at least two different electrical and/or electromagnetic states of the actuation unit via electric coil units energized by current flowing in different flow directions.

It is suggested that at least two activation sequences performed by different actuation elements of the actuation units are associated with at least two different electrical and/or electromagnetic states of the actuation units. An "electrical and/or electromagnetic actuation unit" is a unit which performs at least one activation sequence due to at least one electrical and/or electromagnetic sequence. An "activation sequence" is a sequence, in which a unit and/or a further elementis moved relative to a further unit and/or a further element. An "actuation element" is an element, which participates in an activation sequence. An electrical and/or electromagnetic "state" are values of a current density vector component and/or and electromagnetic field force tensor and/or a charge density within the actuating device and especially at the remaining spatial points in connection with the spatial coordinates belonging to the values. An activation sequence being "associated" with an actuating device means that the actuation element participates in the activation sequence. "Two activation sequences associated with two actuation elements" means that one activation sequence is associated with one actuation element. "Different" electrical and/or electromagnetic states are states which are different in that at least one component of the current density vector and/or of the electromagnetic field strength tensor and/or of the charge density have different prefixes at a spatial point. The actuation unit can be formed in a compact manner with an arrangement according to the invention.

In a preferred embodiment of the invention, the activation sequences are associated with different current flow directions, which depict different electrical states in the above-mentioned sense. A "current flow direction" is especially meant to be a direction of a current flow. An electrical and/or an electromagnetic component, which can especially be a coil and/or a coil unit, can be saved hereby.

It is further suggested that the actuation unit has at least one coil unit, which is provided for the current feed with different current flow directions. "Provided" is especially meant to be specially equipped, and/or designed. A simple construction of the actuation unit can be achieved with a corresponding arrangement according to the invention.

The actuation unit advantageously has at least one aceleration unit, which is provided to accelerate at least one of the actuation elements. An "acceleration of an actuation element" is especially meant to be an acceleration of the actuation element relative to at least one part of the acceleration unit and/or relative to at least one part of the actuation unit, which can especially be a coil. An activation sequence can be performed quickly with the arrangement according to the invention.

It is also suggested that the acceleration unit is at least partially identical to a coil unit of the actuation unit. A simple course of an activation sequence can be achieved hereby.

At least one of the actuation elements has an active magnetic element in a preferred arrangement of the invention. An "active magnetic element" is an electromagnetic element and also a permanent magnet. Activation sequences of different actuation elements can thereby be set in operation in a simple manner.

At least two of the activation sequences are preferably associated with identical actuation directions, wherein the activation sequences associated with identical actuation directions are associated with two different ones of the actuation elements. An "actuation direction" means a direction, in which an actuation element is moved relative to parts of the actuation units and/or the coil unit and especially advantageously by the coil unit during an activation sequence. Activation sequences can be performed in spatial regions spaced from each other with an arrangement according to the invention.

In a preferred arrangement of the invention, the actuation unit has at least one magnetic, electrical and/or electromagnetic stabilization element, which is provided to effect that at least one of the actuation elements stays in at least one stable position. An activation sequence can hereby be especially extended temporally.

It is further suggested that the actuation unit has an active magnetic element, which is at least partially identical to the stabilization element. An especially simple construction of an actuation element can be achieved thereby.

The actuation unit has a safety unit in an especially preferred arrangement, which is provided to only permit one of the activation sequences for one of hte actuation elements at one operating point. A possible destruction of at least one actuation element and/or a component operated by an actuating element can thereby be prevented particulary with simultaneous activation sequences.

It is further suggested that the actuation unit has at least one coil unit and at least an active magnetic element, which together form the safety unit at least partially. A simple construction can be achieved hereby while ensuring a safe operating mode.

In an advantageous arrangement of the invention, the actuation unit has at least one mechanical, pneumatic and/or hydraulic energy storage element which is provided to accelerate at least one actuation element during an activation sequence. An efficient use of released energy can be achieved with the arrangement according to the invention.

The actuating device according to the invention is suitable for different application which appear to be sensible to the expert, however, the actuating device forms an actuation device for an internal combustion engine in an especially advantageous manner, namely especially for a valve drive change-over unit.

The invention will become more readily apparent from the following description of a preferred embodiment thereof with reference to the accompanying drawings.

DESCRIPTION OF A PARTICULAR EMBODIMENT

Figure 1:
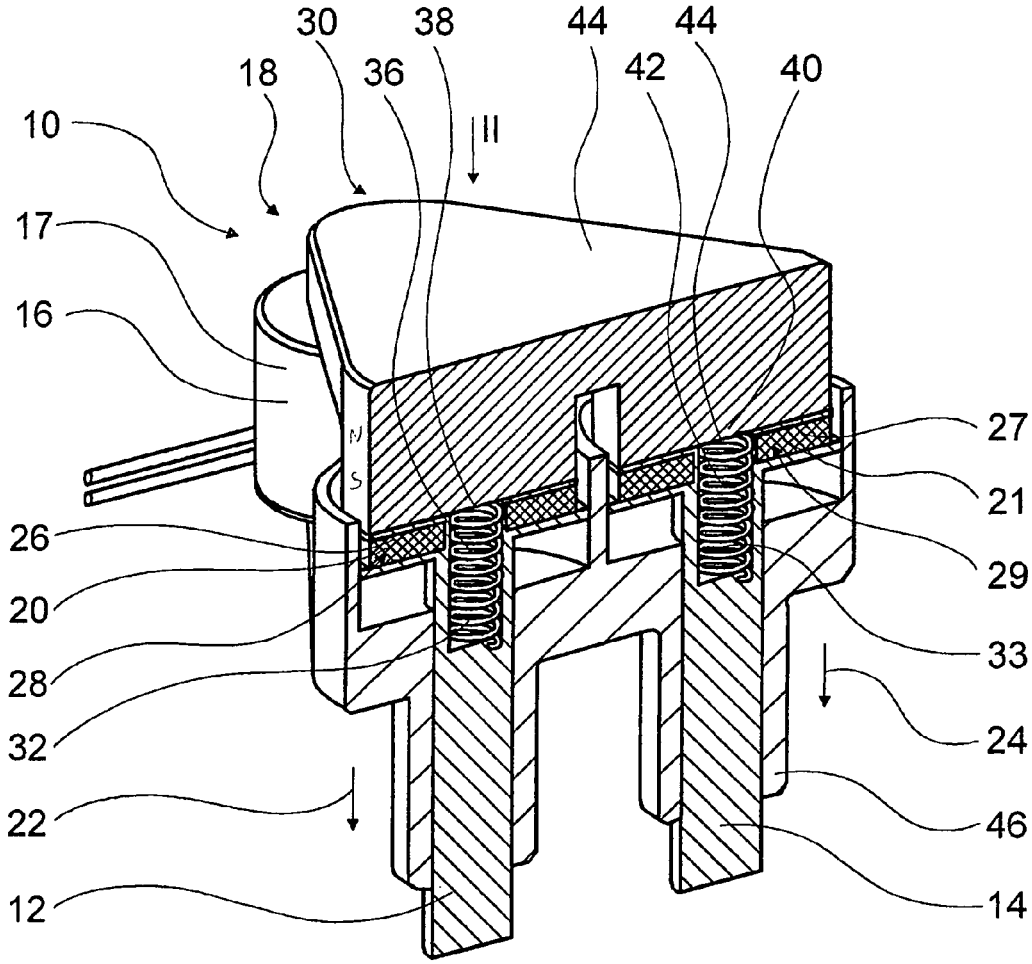
FIG. 1 shows a section through an actuating device.
Figure 3:
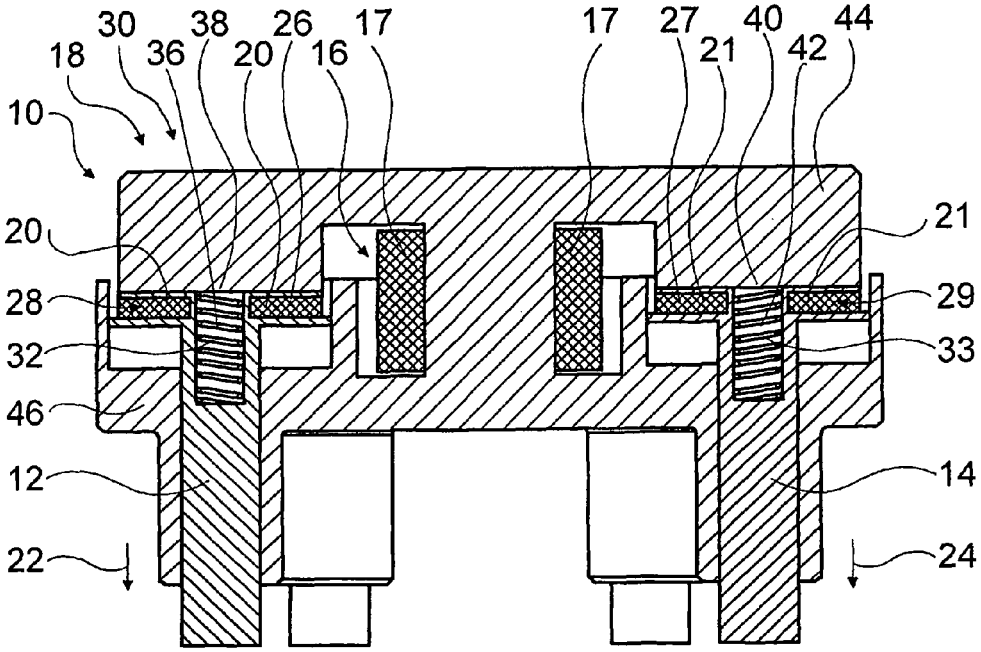
FIG. 3 shows a section through the actuating device.

FIG. 1 shows a section through an actuating device with an electrical and electromagnetic actuation unit 10. The actuation unit 10 has two actuation elements 12, 14. The actuation elements 12, 14 have each a main extension direction, wherein the two main extension directions are identical to each other. The actuation elements 12, 14 have an active magnetic element 20, 21 at respectively one end, which is formed as a permanent magnet. The two ends of the active elements 20, 21 face each other. An extension of a south pole 36 to a north pole 38 of the active element 20 points into the same direction as an extension of a north pole 42 to a south pole 40 of the active element 21, that is why the two active elements 20, 21 have opposite polarity. The active elements 20, 21 respective have the form of a straight hollow cylinder. The base and top areas of the hollow cylinders are perpendicular to the main extension directions. The base areas of the active elements 20, 21 formed as a hollow cylinder are in a common plane. This plane intersects a coil unit 16, which has a coil 17 (FIG. 3). The coil unit 16 is further intersected by a bisector to two centers of mass of the active elements 20, 21, which is parallel to the base areas. The coil unit 16 is arranged next to the active elements 20, 21 in such a manner that forces by means of a magnetic field generated by the coil 17 can be exerted on the active elements 20, 21.

The actuation elements 12, 14 have identical actuation directions 22, 24, which extend parallel to their main extension direction, and from one end of the active elements 20, 21 respectively to an opposite end of the active elements 20, 21. One of the actuation elements 12, 14 is accelerated relative to the coil unit 16 during energization of the coil 17 (FIG. 3) in a current flow direction. The actuation unit 10 thus comprises an acceleration unit 18, which is partially identical to the coil unit 16. If the coil 17 (FIG. 3) is energized with current in a current flow direction opposite to the current flow direction, the other actuation element 12, 14 is accelerated relative to the coil unit 16 due to the opposite polarity of the active elements 20, 21. A movement of one of the actuation elements 12, 14 relative to the coil unit 16 in the actuation directions 22, 24 is an activation sequence which is associated with the moving element 12, 14. As the actuation elements 12, 14 are accelerated by means of different current flow directions, the activation sequences, are associated with different current flow directions. A current flow direction represents an electrical and electromagnetic state of the actuation unit 10. Accordingly, two activation sequences performed by the different actuation elements 12, 14 of the actuation unit 10 are associated with at least two of the different electrical and electromagnetic states of the actuation unit 10. One of the activation sequences, which is performed by one of the actuation elements 12, 14, is associated with this actuation element 12, 14. The two actuation elements 12, 14 perform the activation sequences associated therewith in the same movement direction 22, 24. Accordingly, at least two of the activation sequences are associated with the identical actuation directions 22, 24, wherein the two activation sequences associated with the identical actuation directions 22, 24 are associated with two different ones of the actuation elements 12, 14.

Figure 4:
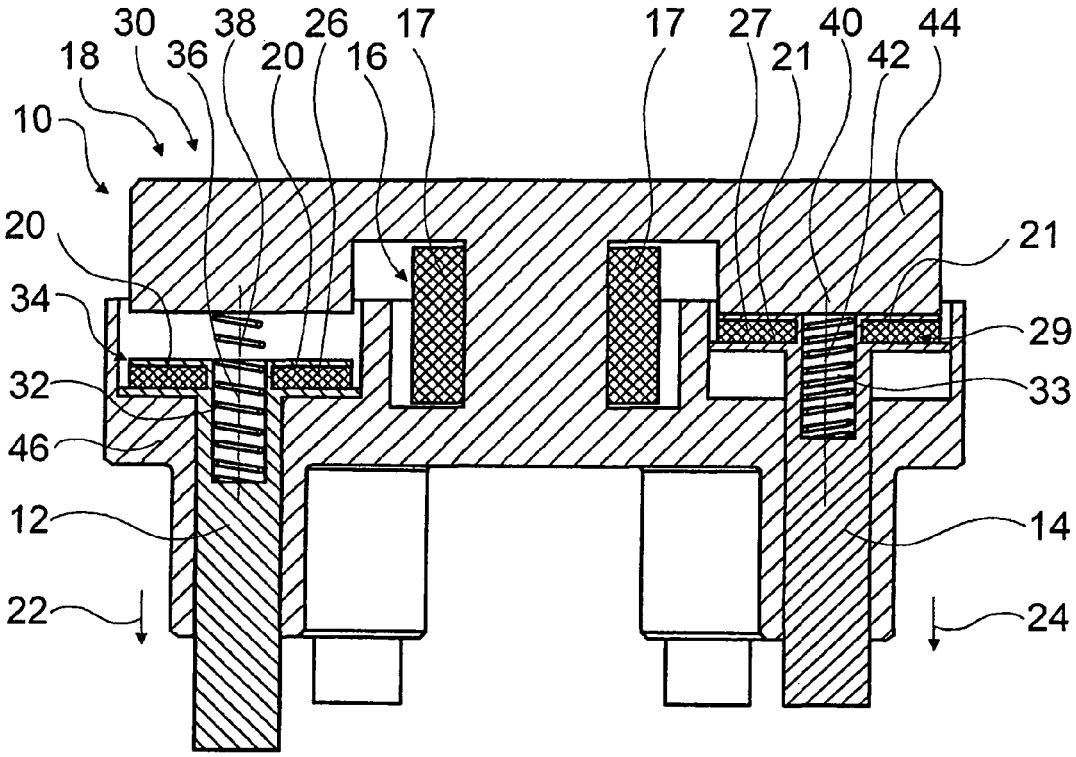
FIG. 4 shows a section through the actuating device.

The actuation unit 10 further has two magnetic, electrical and electromagnetic stabilization elements 26, 27. The stabilization elements 26 or 27 are provided to cause the actuation elements 12 or 14 to stay in at least one stable position 28 or 29. The stabilization elements 26 or 27 are identical to the active elements 20, 21. A movement of the actuation elements 12, 14 relative to the coil unit 16 is limited in the actuation direction 22 by surfaces of a covering unit 46. The covering unit 46 encloses the actuation elements 12, 14. As the surfaces are at least partially formed of a material which can exert a force on a permanent magnet, the active elements 20, 21 are attracted by the surfaces and an underlying material and are thus held in a stable position 34 (FIG. 4). A movement of one of the actuation elements 12, 14 in the opposite direction of the actuation direction is further limited by a holding unit 44, which is connected to the coil unit 16. As the holding unit 44 is at least partially formed of a material which can exert a force on a permanent magnet, the stabilization element 26, 27 causes that the actuation element 12, 14 stays in the stable position 28, 29 deflected maximally in the opposite direction of the actuation direction 22 by means of a force exerted thereon by the holding unit 44.

After an activation sequence of one of the actuation elements 12, 14, the respective actuation element 12, 14 is moved back into the stable position 28 or 29. An energization of the coil (FIG. 3) then takes place by a current flow direction, which is opposed to the current flow direction, which was used for an acceleration of the actuation element 12, 14. The actuation unit 10 thus has a safety unit 30 in the form of the coil 17 (FIG. 3) and the active elements 20, 21, which is provided to permit at any operating point only one of the activation sequences of one of the actuation elements 12, 14.

The actuation unit 10 additionally has two mechanical energy storage elements 32, 33 formed as helical springs, which are provided to accelerate the actuation elements 12, 14 relative to the coil unit during the activation sequences. The helical springs are arranged between the actuation elements 12, 14 and the holding unit 44 and are in the compressed state if the actuating elements 12, 14 are in the stable positions 28, 29. During an activation sequence, one of the energy storage elements 32, 33 decompresses and accelerates one of the actuation elements 12, 14.

Figure 2:
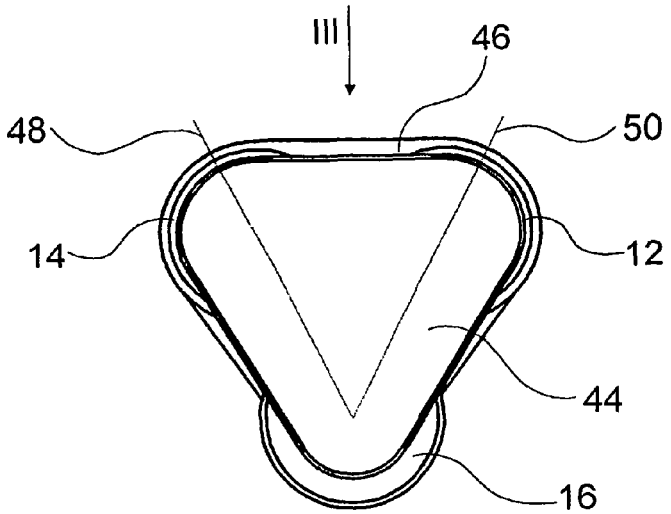
FIG. 2 shows a plan view of the actuating device.

FIG. 2 shows a plan view from above of an actuating device in the actuation direction 22. The holding unit 44 partially' covers the coil unit 16, the covering unit 46, and the actuation elements 12, 14. Two closed half-planes 48, 50 are represented in a projecting manner in the figure. The half-planes 48, 50 intersect in a straight line, which delimit the two half-planes 48, 50 in planes into which the half-planes 48, 50 extend. The straight line intersects the coil unit in the center. The half-plane 48 intersects the actuation element 14 in the center; the other half-plane 50 intersects the actuation element 12 in the center.

FIG. 3 shows the actuating device in a section along the half-planes 48, 50 (FIG. 2), so that the coil unit 16 and the actuation elements 12, 14 are visible. The coil unit 16 comprises the coil 17. The actuation elements 12, 14 are in the stable positions 28, 29. The coil 17 can conduct current at a point in a direction orthogonal to the actuation direction 22 (FIG. 1) and thus trigger an activation sequence of one of the actuation elements 12, 14. The coil 17 can also conduct current in the direction opposite to the orthogonal direction and thus trigger an activation sequence of the other actuation element 12, 14.

FIG. 4 shows the actuating device in a section as shown in FIG. 3. The actuation element 32 is completely deflected into the actuation direction 22. It is thus arranged in the stable position 34.

What is claimed is:

1. An actuating device for a valve drive changeover unit of an internal combustion engine comprising an actuation unit (10), with at least two movable actuation elements (12, 14) which are each provided at one end thereof with an active permanent magnetic element (20, 21) however of opposite polarity and with at least one coil unit (16) which can be energized selectively by currents in opposite flow directions providing for at least two different electrical or electromagnetic states of the actuation unit (10) for performing activation sequences of the actuation unit (10) dependent on different current flow directions, the at least one coil unit (16) being arranged next to the active permanent magnetic elements (20, 21) in such a way that, by means of magnetic forces generated by the coil unit (16) acting on the active magnetic elements (20, 21), when energized in one direction of current flow through the coil unit (16) one of the movable actuation elements (12, 14) is accelerated relative to the coil unit (16) and, when energized in the opposite direction of current flow through the coil unit (16), as a result of the opposite polarity of the active permanent magnetic actuation elements (20, 21), the other of the movable actuation elements (12, 14) is accelerated.

2. The actuating device according to claim 1, wherein the actuation unit (10) has at least one acceleration unit (18) for accelerating at least one of the movable actuation elements (12, 14).

3. The actuating device according to claim 2, wherein the acceleration unit (18) is at least partially identical with a coil unit (16) of the actuation unit (10).

4. The actuating device according to claim 1, wherein at least two of the activation sequences are associated with identical actuation directions (22, 24) and the activation sequences associated with identical actuation directions (22, 24) are associated with two different ones of the movable actuation elements (12, 14).

5. The actuating device according to claim 1, wherein the actuation unit (10) comprises at least one of a magnetic, an electrical and an electromagnetic stabilization element (26, 27) for retaining at least one of the actuation elements (12, 14) in at least one stable position (28, 29, 34).

6. The actuating device according to claim 5, wherein the actuation unit (10) has an active magnetic element (20, 21) which is at least partially identical to the stabilization element (26, 27).

7. The actuating device according to claim 1, wherein the actuation unit (10) has at least one energy storage element (32), for accelerating at least one of the movable actuation elements (12, 14) during an activation sequence.

* * * * *